US011136926B2

(12) United States Patent
Schuhmacher et al.

(10) Patent No.: US 11,136,926 B2
(45) Date of Patent: Oct. 5, 2021

(54) METHOD FOR OPERATING A RECIPROCATING PISTON INTERNAL COMBUSTION ENGINE

(71) Applicant: Daimler AG, Stuttgart (DE)

(72) Inventors: Thomas Schuhmacher, Stuttgart (DE); Marc Oliver Wagner, Esslingen am Neckar (DE)

(73) Assignee: Daimler AG, Stuttgart (DE)

( * ) Notice: Subject to any disclaimer, the term of this patent is extended or adjusted under 35 U.S.C. 154(b) by 269 days.

(21) Appl. No.: 16/472,741

(22) PCT Filed: Sep. 20, 2017

(86) PCT No.: PCT/EP2017/001117
§ 371 (c)(1),
(2) Date: Jun. 21, 2019

(87) PCT Pub. No.: WO2018/114019
PCT Pub. Date: Jun. 28, 2018

(65) Prior Publication Data

US 2021/0131357 A1 May 6, 2021

(30) Foreign Application Priority Data

Dec. 22, 2016 (DE) ..... 10 2016 015 457.8

(51) Int. Cl.
*F02D 13/04* (2006.01)
*F01L 13/06* (2006.01)
*F02D 13/02* (2006.01)

(52) U.S. Cl.
CPC ..... *F02D 13/04* (2013.01); *F01L 13/065* (2013.01); *F02D 13/0246* (2013.01)

(58) Field of Classification Search
CPC ..... F02D 13/04; F02D 13/0246; F02D 2041/001; F02D 41/0002; F02D 41/123; F02D 13/0242; F01L 13/065; Y02T 10/40
See application file for complete search history.

(56) References Cited

U.S. PATENT DOCUMENTS 4,592,319 A 6/1986 Meistrick
5,146,890 A * 9/1992 Gobert ..... F02D 13/04 123/321

(Continued)

FOREIGN PATENT DOCUMENTS

CN 86 1 00053 A 10/1986
CN 86 1 03699 A 2/1987

(Continued)

OTHER PUBLICATIONS

PCT/EP2017/001117, International Search Report dated Dec. 21, 2017 (Three (3) pages).

(Continued)

*Primary Examiner* — Hung Q Nguyen
(74) *Attorney, Agent, or Firm* — Crowell & Moring LLP

(57) ABSTRACT

A method for operating a reciprocating piston internal combustion engine in an engine braking mode includes moving an outlet valve of a first cylinder for a first time into a closed position, subsequently for a first time into an open position, subsequently in a direction of the closed position, and subsequently for a second time into the open position. The outlet valve is held open during the moving in the direction of the closed position for such a long time that the first cylinder is filled with gas which flows via an outlet duct out of a second cylinder. The outlet valve is moved, during the moving in the direction of the closed position, into an intermediate position which lies between the open position and the closed position, where from the intermediate posi- (Continued)

tion the outlet valve is moved for the second time into the open position.

5 Claims, 3 Drawing Sheets

(56) References Cited

U.S. PATENT DOCUMENTS

| | | | | |
|---|---|---|---|---|
| 6,394,067 | B1 | 5/2002 | Usko et al. | |
| 6,418,720 | B1 * | 7/2002 | Cornell | F02B 37/22 60/602 |
| 7,591,244 | B2 * | 9/2009 | Auffret | F02D 13/04 123/321 |
| 2004/0055549 | A1 * | 3/2004 | Petrie | F01L 1/267 123/90.16 |
| 2005/0087170 | A1 * | 4/2005 | Rammer | F01L 13/065 123/321 |
| 2014/0074378 | A1 | 3/2014 | Iwai et al. | |
| 2016/0319753 | A1 * | 11/2016 | Wagner | F01L 13/06 |

FOREIGN PATENT DOCUMENTS

| | | | |
|---|---|---|---|
| CN | 105829683 | A | 8/2016 |
| CN | 108368780 | A | 8/2018 |
| CN | 110088453 | A | 8/2019 |
| DE | 10 2007 038 078 | A1 | 2/2009 |
| JP | 2013-174167 | A | 9/2013 |
| WO | WO 2004/059131 | A2 | 7/2004 |
| WO | WO 2015/090522 | A2 | 6/2015 |
| WO | WO 2017/102042 | A1 | 6/2017 |

OTHER PUBLICATIONS

Chinese Office Action issued in Chinese application No. 201780078711.2 dated Apr. 23, 2021, with partial English translation (Thirteen (13) pages).

* cited by examiner

METHOD FOR OPERATING A RECIPROCATING PISTON INTERNAL COMBUSTION ENGINE

BACKGROUND AND SUMMARY OF THE INVENTION

The invention relates to a method for operating a reciprocating piston internal combustion engine.

Such a method for operating a reciprocating piston internal combustion engine in an engine braking mode is already known, for example, from U.S. Pat. No. 4,592,319. In engine braking mode, the reciprocating piston internal combustion engine is used as a brake, that is, as an engine brake, for example for braking a motor vehicle. In a downhill run, for example, the reciprocating piston internal combustion engine is used in the engine braking mode, to keep the speed of the motor vehicle at least substantially constant or to avoid that the speed of the motor vehicle increases excessively. By using the reciprocating piston internal combustion engine as an engine brake a service brake of the motor vehicle can be spared. In other words, the use of the service brake can be avoided or kept low by using the reciprocating piston internal combustion engine as an engine brake.

To this end, in the method, it is envisaged that the reciprocating piston internal combustion engine is used or operated as a decompression brake. In other words, the reciprocating piston internal combustion engine is operated in the engine braking mode in the manner of a decompression brake, which is well-known from the prior art. As part of the engine braking mode within a work cycle of the reciprocating piston internal combustion engine, at least one outlet valve movable between a closed position and at least one open position of at least one cylinder-shaped combustion chamber of the reciprocating piston internal combustion engine moves a first time into the closed position, i.e., it is closed for a first time. The outlet valve is associated with an outlet duct through which exhaust gas of the reciprocating piston internal combustion engine may flow. In the closed position of the outlet valve, the outlet valve fluidly blocks the outlet duct so that no gas can flow from the cylinder into the outlet duct. However, in the open position, the outlet valve opens the associated outlet duct, so that gas can flow from the cylinder into the outlet duct. In engine braking mode, the gas is air, for example, or the gas comprises at least air and no exhaust gas of the reciprocating piston internal combustion engine, for example, since in the engine braking mode, for example, a fired operation of the reciprocating piston internal combustion engine is suppressed.

The fired operation is also referred to as fueled operation, wherein during fired operation combustion processes occur in the cylinder or in the reciprocating piston internal combustion engine. If the fired operation is suppressed, then the reciprocating piston internal combustion engine is in its unfired operation, which is also referred to as unfueled operation. During unfired operation, no combustion processes take place in the reciprocating piston internal combustion engine, in particular the cylinders thereof.

Due to the fact that the outlet valve moves within the work cycle for a first time into the closed position, i.e., it is closed for a first time, by means of a piston, which is translationally movable within the cylinder piston, a gas, which is initially in the cylinder, such as fresh air, may be compressed. Following the first movement of the outlet valve into the closed position, the outlet valve is moved from the closed position into the open position for a first time, i.e., the outlet valve is opened for a first time, so that the air previously compressed by the piston, is discharged from the cylinder, in particular abruptly. By this discharge of the compressed air, compression energy stored in the compressed air and applied by the piston can no longer be used to move the piston from its top dead center to its bottom dead center or to assist in such a movement. In other words, the compression energy is discharged from the cylinder at least mostly unused. The fact that the piston or the reciprocating piston internal combustion engine has to apply or has already applied work for compressing the gas in the cylinder, wherein this work cannot be used for moving the piston from the top dead center to the bottom dead center, due to the opening of the outlet valve, i.e., as a result of the movement of the outlet valve in the open position, allows the vehicle to be braked.

After the first or initial movement of the outlet valve into the open position, the outlet valve is moved from the open position in the direction of the closed position. As a result, for example, gas still in the cylinder can be recompressed by means of the piston. After the movement of the outlet valve in the direction of the closed position subsequent to the first opening of the outlet valve, the outlet valve is moved for a second time into the open position, i.e., it is opened for a second time, so that the previously compressed gas can be discharged from the cylinder also for a second time, without the compression energy stored in the gas may be used for moving the piston from its top dead center to its bottom dead center. The previously described first movement of the outlet valve into the closed position, the subsequent first movement of the outlet valve into the open position, the subsequent movement of the outlet valve in the direction of the closed position and the subsequent second movement of the outlet valve into the open position are performed within a work cycle and serve to discharge gas, which was compressed by means of the piston in the cylinder, from the cylinder.

Usually, the piston is articulately coupled, via a connecting rod, to a crankshaft of the reciprocating piston internal combustion engine. In this case, the piston is received in the cylinder translationally movable relative to the cylinder, wherein the piston moves between its bottom dead center and its top dead center. As a result of the articulated coupling with the crankshaft, the translational movements of the piston are converted into a rotational movement of the crankshaft, so that the crankshaft rotates about an axis of rotation. As a work cycle, exactly two full revolutions of the crankshaft are considered in a four-stroke engine. This means that a work cycle of the crankshaft includes exactly 720 degrees of crank angle. Within these 720 degrees of crank angle [° CA], the piston moves twice to its top dead center and twice to its bottom dead center. In a two-stroke engine, a work cycle is understood to be exactly one revolution of the crankshaft, i.e., 360 degrees crank angle [° CA].

The engine braking mode differs from normal operation in particular in that in the engine braking mode the reciprocating piston internal combustion engine is operated without fuel injection, wherein the reciprocating piston internal combustion engine is driven by wheels of the motor vehicle, in particular via the crankshaft. In normal operation, however, the reciprocating piston internal combustion engine is operated in a so-called traction mode, in which the wheels are driven by the reciprocating piston internal combustion engine. In addition, in normal operation, the previously described fired operation takes place, in which not only air but also fuel is introduced into the cylinder. This results in normal operation in a fuel-air mixture in the cylinder, wherein the fuel-air mixture is ignited and thereby burned.

In the engine braking mode, however, no fuel is introduced into the cylinder, for example, so that the reciprocating piston internal combustion engine in the engine braking mode is operated in their unfired operation.

In addition, DE 10 2007 038 078 A1 discloses a gas exchange valve actuating device, in particular for an internal combustion engine, having at least one firing camshaft, in particular an outlet camshaft, which is phase-adjustable relative to a crankshaft by means of a firing camshaft adjusting device, and a decompression braking device comprising at least one braking cam and at least one decompression gas exchange valve. In this case, an adjusting device is provided, which is designed to set a decompression gas exchange actuating time.

The object of the present invention is to develop a method of the type mentioned above such that a particularly advantageous braking performance and a particularly advantageous starting of the internal combustion engine subsequent to the engine braking mode can be realized.

In order to develop a method such that a particularly advantageous, especially a particularly high, braking power and a particularly advantageous starting of the internal combustion engine subsequent to the engine braking mode can be realized, it is provided according to the invention that the outlet valve is held open during the movement in the direction of the closed position, which movement follows the first movement into the open position and precedes the second movement into the open position, for such a long time that the cylinder is filled with gas which flows via at least one outlet duct out of at least one second cylinder of the reciprocating piston internal combustion engine. In other words, according to the invention it is provided to introduce gas from at least one second cylinder into the first cylinder and thereby to charge the first cylinder with the gas from the second cylinder. This allows at least a so-called backward charging after a first decompression cycle of the first cylinder. The outlet valve of the first cylinder is then timely moved in the direction of the closed position after the first movement into the open position and before the second movement into the open position, in particular from the open position, so that gas now present in the first cylinder and originating from the second cylinder is compressed by means of the piston of the first cylinder. Thereafter, the outlet valve of the first cylinder may be opened for a second time, i.e., it is moved for a second time into the open position, so that the first cylinder performs a second decompression cycle and the compression energy stored in the compressed gas can not be utilized to move the piston of the first cylinder back from its top dead center to its bottom dead center.

The outlet valve of the first cylinder thus performs at least two successive decompression strokes within one work cycle or the work cycle, whereby the two decompression cycles of the first cylinder are effected. In this case, the second decompression cycle is charged one or multiple times backwards, since during the second decompression cycle the gas of the second cylinder is present in the first cylinder. By this reverse charging of the second decompression cycle, a particularly high engine braking performance can be provided in the engine braking mode. Preferably, the second decompression cycle or the second decompression stroke is designed so that the pressure in the first cylinder does not rise above the value, against which the at least one inlet valve of the first cylinder can be kept in a permanent open position.

Compared to conventional valve controls in four-stroke engines in engine braking mode, a significant increase in engine braking power can be realized by the inventive method, in particular in a lower speed range.

In addition, it is provided according to the invention that when activating the engine braking mode, a camshaft for actuating at least one gas exchange valve of the reciprocating piston internal combustion engine is adjusted. In particular, it is provided that the camshaft to be adjusted is an inlet camshaft, by means of which at least one inlet valve can be actuated as the gas exchange valve. This inlet valve is associated, for example, with an inlet duct, via which the first cylinder is filled with the gas. The inlet valve is movable, for example, between a closed position fluidically obstructing the inlet duct and at least one open position opening the inlet duct and is thereby movable by means of the camshaft from the closed position to the open position.

It is preferably provided that the inlet camshaft is adjusted before the performing of the actual engine braking mode, that is, before the previously described actuation of the outlet valve. In other words, initially the inlet camshaft is adjusted, whereupon the outlet valve is actuated in the manner previously described and in the following or the first cylinder is filled.

In addition, in order to start the internal combustion engine, in particular after the engine braking mode or when terminating the engine braking mode, in a particularly advantageous and simple way, according to the invention it is provided that a movement of the outlet valve into the closed position is suppressed during the movement in the direction of the closed position, which movement follows the first movement into the open position and precedes the second movement into the open position. This means that the movement of the outlet valve which takes place after the first opening and before the second opening is not a movement of the outlet valve into the closed position, i.e., it is not a closing or full closing of the outlet valve, but instead the outlet valve is moved, for example, during the movement of the outlet valve, which takes place after the first opening and before the second opening, in the direction of the closed position in an intermediate position, which is different from the closed position and the open position, in which the outlet valve opens, in particular partially, a corresponding outlet duct, i.e., an outlet duct which is associated with the outlet valve and the first cylinder.

The aforementioned outlet duct, through which the gas is supplied to the first cylinder to charge the first cylinder for the second decompression cycle, is also referred to as the first outlet duct. The outlet duct associated with the outlet valve is therefore referred to as the second outlet duct, wherein the gas flowing out of the second cylinder via the first outlet duct is supplied to the first cylinder via the second outlet duct. In the closed position, the outlet valve is fully closed, so that the outlet valve completely closes the associated second outlet duct in the closed position. As a result, no gas can flow from the first cylinder into the second outlet duct. In the open position, the outlet valve opens the associated second outlet duct, so that gas can flow from the first cylinder into the second outlet duct. Also in the intermediate position, the outlet valve opens the associated second outlet duct so that gas can flow from the cylinder into the second outlet duct. In this case, the intermediate position is different from the open position and the closed position and is positioned, for example, between the open position and the closed position of the outlet valve, which is translationally movable, for example.

The outlet valve is thus moved, after the first movement into the open position, that is, after the first opening, from the open position into the intermediate position and then in the curve of the second movement into the open position, i.e., it is moved in the curve of the second opening, from the intermediate position into the open position.

The invention is based on the fact that the inventive method provides an engine brake in the form of a three-stroke engine braking system. It has been found that—if no corresponding countermeasures are taken—the second decompression stroke or the second decompression cycle is limited insofar as a pressure in the first cylinder, which is also referred to as cylinder pressure, cannot exceed a maximum allowable cylinder pressure against which the inlet valve can open, since otherwise the inlet valve cannot be opened, i.e., moved from its closed position to its open position and thus the inlet duct cannot be opened. In other words, it is desirable that the pressure in the first cylinder, at the time when the inlet valve is opened, is small enough to open the inlet valve, so that the first cylinder can be filled with the gas.

Since the inlet valve usually begins to open before top dead center and the maximum cylinder pressure in engine braking mode occurs at approximately the same crank angle and the maximum allowable cylinder pressure against which the inlet valve is allowed to open is in the range of about 20 bar, while otherwise the allowable cylinder pressure is above 60 bar, the restrictions prevent the full potential of the three-stroke engine braking system from being used. In order to avoid this problem and to be able to use the full potential of the three-stroke engine braking system, that is to realize a particularly high braking power, the camshaft, in particular the inlet camshaft, is adjusted.

When activating the engine braking system or the engine braking mode, very high cylinder pressures may occur, especially at high speeds and charge pressures, so that at low cylinder pressures lower than 20 bar, the adjustment of the inlet camshaft toward late and the actuation of the outlet valve in engine brake mode can be performed simultaneously. Furthermore, it is conceivable to first actuate the outlet valve according to the engine braking mode and then to retard the inlet camshaft. This allows the inlet valve to be adjusted before, during or after activation of the engine braking system.

Such an adjustment of the inlet camshaft means that the inlet camshaft is rotated, and thus adjusted, by means of a camshaft adjuster, which is also referred to as a phase adjuster, relative to an output shaft of the reciprocating piston internal combustion engine which is designed as a crankshaft. The crankshaft is thus an output shaft, by means of which the inlet camshaft is driven.

This means that the invention is based on the idea of combining a three-stroke engine braking system with a camshaft adjuster. The camshaft adjuster permits a displacement of the crankshaft region, in which the gas exchange valve, in particular the inlet valve, is opened, in particular towards later crank angles. Thus, it is possible to retard the opening time of the inlet valve so that the cylinder pressure due to the open outlet valve and the downward movement of the piston occurring after the top dead center has dropped so far that the limit value for the maximum cylinder pressure with open inlet valve is maintained even when the maximum cylinder pressure during decompression is equal to 60 bar or more.

As a result of the activation of the engine braking mode, it is thus provided that the camshaft, in particular the inlet camshaft, is set in a suitable position or in a suitable rotational position, in particular by retarding. During engine braking mode, the inlet camshaft is set to a position which is advantageous for engine braking mode. After switching off or deactivating the engine braking mode, the inlet camshaft is again rotated to a position, i.e., rotational position, which is advantageous or optimal for normal operation or fired operation of the reciprocating piston internal combustion engine. The camshaft adjuster preferably has a fail-safe position of the camshaft in case of malfunction of the camshaft adjuster, wherein this fail-safe position is preferably the retarded position or rotational position of the camshaft.

The reciprocating piston internal combustion engine is preferably operable in the fired mode and in an unfired mode. The fired mode is also referred to as a fueled operation. During the fired mode, combustion processes occur in the reciprocating piston internal combustion engine, in particular in its cylinders and thus in particular in the first cylinder and in the second cylinder. In the unfired mode, which is also referred to as unfueled operation, however, those combustion processes occurring in the reciprocating piston internal combustion engine, especially in the cylinders, are suppressed, wherein the reciprocating piston internal combustion engine operates in the unfired mode during the engine braking mode, for example.

In the normal operation, the reciprocating piston internal combustion engine is preferably in the fired mode, in particular in a traction mode. In order to transfer the reciprocating piston internal combustion engine, for example, from the engine braking mode into normal operation mode and thus from the unfired mode to the fired mode, the reciprocating piston internal combustion engine is started. Starting or activating the reciprocating piston internal combustion engine thus means starting or activating the fired operation and thus starting or activating the operation of combustion processes in the reciprocating piston internal combustion engine.

Due to the fact that the outlet valve after the first opening and before the second opening is not in the closed position and thus not fully closed, but is instead moved to the intermediate position and thus is still being held open, the starting of the reciprocating piston internal combustion engine can be performed in a particularly advantageous manner.

On the other hand, the invention is based on the idea that conventionally when starting a reciprocating piston internal combustion engine, which is also referred to as an internal combustion engine or engine, a starting device for starting the reciprocating piston internal combustion engine must work against the compression of the gas in the respective cylinder, resulting in a thermodynamic power loss. The aforementioned starting device is commonly referred to as a starter and used, for example, to rotate the crankshaft until combustion processes occur in the cylinders. The compression usually leads to a torque that varies greatly over a crank revolution, which on the one hand entails large electrical currents in the starter and, on the other hand, can cause the engine to vibrate in its engine mounts. This can in particular cause a perceivable excitation in the range of the resonant frequencies of engine support, for example in the range from 200 to 300 revolutions per minute. In other words, the starter is, for example, an electric motor in which, when starting the internal combustion engine, conventionally very high currents and the associated disadvantages can occur.

Therefore, according to the invention, it is provided to further develop the previously described three-stroke engine braking system such that in addition a decompression during startup of the reciprocating piston internal combustion engine can be avoided, so that thermodynamic losses usually resulting when starting the reciprocating piston internal combustion engine can be minimized. According to the invention this is achieved in that the outlet valve is not completely but only partially closed between the first movement into the closed position (first closing) and the second movement into the open position (second opening), so that gas may escape from the first cylinder before the top dead center (TDC), which is configured, for example, as a gas exchange TDC, of the piston arranged in the first cylinder. As a result, no appreciable compression occurs at low speeds in the first cylinder. This movement or actuation of the outlet valve can be readily transferred to other cylinders, in particular to the second cylinder, of the reciprocating piston internal combustion engine.

The partial closing of the outlet valve means—as described above—that the outlet valve, during the movement into the closed position which follows the first opening and precedes the second opening, does not completely move into the closed position, but into the intermediate position and is thus still kept partially open.

It has been found to be particularly advantageous if the outlet valve in the intermediate position closes the second outlet duct of the reciprocating piston internal combustion engine, which belongs to or is associated with the outlet valve, more than in the open position and opens it more than in the closed position. In other words, in the open position, the outlet valve opens a first flow cross section, via which the flow can flow from the first cylinder into the second outlet duct.

In the intermediate position, the outlet valve opens a second flow cross section, via which gas can flow from the first cylinder into the second outlet duct. In this case, the second flow cross section is smaller than the first flow cross section, the respective flow cross section being different from zero or having a value different from zero. This means that the outlet valve does not completely close the second outlet duct neither in the open position nor in the closed position, while the outlet valve completely closes the second outlet duct in the closed position.

The outlet valve is thus less widely opened in the intermediate position and is thus more closed than in the open position, so that the outlet valve has an opening stroke in the intermediate position. This opening stroke is preferably designed so that a sufficiently high or strong compression occurs in the first cylinder—although the outlet valve is in the intermediate position and thus is not closed—at speeds, which are relevant for the engine braking mode, so that a high engine braking performance can be maintained in the engine braking mode.

It has also been found to be particularly advantageous if the inlet camshaft, in particular by means of the phase adjuster, is set at a very late position of, for example, 120 degrees of crank angle, so that, for example, even at the top dead center (TDC) formed as a top ignition dead center (ignition—TDC) of the piston arranged in the first cylinder following the intermediate position no compression or excessive compression occurs, since either the inlet valve or the outlet valve is opened. In other words, it is preferably provided that the inlet camshaft is retarded so that the inlet valve is open during a top ignition dead center of the work cycle.

By means of the method according to the invention it is thus possible to globally achieve a high engine braking performance and at the same time to provide a particularly efficient operation of the reciprocating piston internal combustion engine, since thermodynamic losses resulting from starting the reciprocating piston internal combustion engine can be kept particularly low.

For example, the outlet valve is actuated by means of a so-called braking cam of a camshaft during the engine braking mode. It has been found that such a form of the braking cam can be manufactured in a simple manner, that the described actuation or movement of the outlet valve and in particular the movement into the intermediate position can be effected by means of the braking cam.

In order to complete the three-stroke braking system by the described movement of the outlet valve in the intermediate position, no additional parts are necessary, so that a start-up supporting function, in the context of which—as described above—, the thermodynamic losses when starting the reciprocating piston internal combustion engine can be kept very low, can be provided without additional material costs. The compression at the beginning of the starting process is at least almost completely eliminated, so that loads acting on bearings of the reciprocating piston internal combustion engine, in particular the crankshaft, can be kept particularly low, in particular in a period of time during which the bearings are not supplied or not sufficiently supplied with lubrication or pressure oil. In particular, engine mounts are not excited due to the suppression of the compression, so that a particularly comfortable engine start occurs, both in case of an engine start caused by a starter, in which the engine brake is timely switched off before the start of the injection, and when the reciprocating piston internal combustion engine is started.

The function described above with regard to engine starting can be used without difficulty also when deactivating or stopping the reciprocating piston internal combustion engine. Such a shutdown of the reciprocating piston internal combustion engine means, for example, that the reciprocating piston internal combustion engine is transferred from its fired mode into the unfired mode.

Through the use of the camshaft adjuster, it is possible to further increase a particularly high engine braking performance, which can be achieved by means of the three-stroke engine braking system, which can be realized by particularly simple and inexpensive means in the form of the cam actuator. In addition, it is possible, by means of the method according to the invention, to avoid further restrictions with regard to the engine braking power through switch-on and switch-off conditions, in particular in the case of a mechanical conversion, in which the limit value of the maximum permissible cylinder pressure with open inlet valve again comes into play, so that a high braking power can be realized.

In a further embodiment it can be provided that, in the engine braking mode within a work cycle, at least a second outlet valve of the second cylinder is closed for a first time, then subsequently opened for a first time, then subsequently closed for a second time and subsequently opened for a second time, thereby to discharge compressed gas from the second cylinder by means of a second piston of the second cylinder into the second cylinder. As previously stated, the movement or actuation of the first outlet valve can be transferred to the second outlet valve, so then, for example, the second closing of the second outlet valve is suppressed. Instead of the second closing of the second outlet valve, it is then provided, for example, that the second outlet valve is moved, after the first opening and before the second opening, in the direction of the closed position of the second outlet valve and into an intermediate position arranged between the open position and the closed position, so that between the first opening and second opening of the second outlet valve, a movement of the second outlet valve into the closed position is suppressed. This means that the second cylinder or the second outlet valve of the second cylinder can be operated in the manner of the first cylinder or in the manner of the first outlet valve of the first cylinder.

In this case, the first cylinder is filled with at least a portion of the gas discharged from the second cylinder, while the second outlet valve of the second cylinder is at least partially opened after its second opening and before its first closing or after its first opening and before the second opening, in particular after the first opening and before the intermediate position. Due to the fact that the second outlet valve and the first outlet valve are at least partially open, the gas compressed by means of the second piston may flow on an outlet or exhaust side of the reciprocating piston internal combustion engine out of the second cylinder and into the first cylinder via the second outlet duct of the first cylinder. Thus, a decompression cycle or a decompression stroke of the second cylinder and the second outlet valve is used to charge the first cylinder for the second decompression cycle. Due to this charge, a particularly high amount of air is present in the first cylinder during its second decompression stroke, so that a particularly high braking power can be realized.

A particularly high charge of the first cylinder can be provided in that the outlet valve of the first cylinder is kept open after the first opening and before the second opening, in particular after the first opening and before the intermediate position, for so long that the first cylinder is filled with corresponding gas, which flows on the exhaust side via at least one respective outlet duct from the second cylinder and at least one third cylinder of the reciprocating piston internal combustion engine. This means that the first cylinder is no longer only charged with gas from the second cylinder, but also with gas from the third cylinder, so that a particularly high engine braking performance can be realized.

In a further embodiment of the invention, in the engine braking mode within a work cycle at least a second outlet valve of the second cylinder is closed for a first time, then subsequently opened for a first time, then subsequently closed for a second time or moved into the intermediate position for a second time, thereby discharging compressed gas from the second cylinder by means of a second piston of the second cylinder in the second cylinder. As already mentioned, it is provided that the second cylinder and its second outlet valve can be operated in the manner of the first cylinder and the first outlet valve. In addition, it is provided that in the engine braking mode within a work cycle, at least a third outlet valve of a third cylinder is closed for a first time, subsequently opened for a first time, then subsequently closed for a second time or moved to the intermediate position and subsequently opened for a second time, to thereby discharge gas compressed in the third cylinder by means of a third piston of the third cylinder from the third cylinder. This also means that the third cylinder and its third outlet valve can be operated in the manner of the first cylinder and the first outlet valve. As a result, a decompression brake is realized in the three cylinders, so that a particularly high engine braking performance can be realized.

The first cylinder is filled, for example, with at least part of the gas discharged from the second cylinder, while the second outlet valve is opened after its second opening and before its first closing. Further, the first cylinder is filled with at least a part of the gas discharged from the third cylinder, while the third outlet valve is at least partially opened after its first opening and before its second closing or after its first opening and the intermediate position. In this case, it is thus provided to use the second decompression cycle of the second cylinder and the first decompression cycle of the third cylinder to charge the first cylinder for its second decompression cycle. As a result, during the second decompression cycle, a particularly high amount of air is present in the first cylinder, so that a particularly high engine braking performance can be realized.

Furthermore, it is provided, for example, that the first cylinder is filled for its first decompression cycle with gas in the form of fresh air over at least one inlet duct. In this case, an inlet valve associated with the inlet duct is at least partially in its open position, so that in case of a movement of the piston of the first cylinder from the top dead center to the bottom dead center, gas can be sucked in the form of fresh air through the inlet duct into the first cylinder. This fresh air can then be compressed in the first decompression cycle by means of the piston of the first cylinder. The compressed fresh air flows out of the first cylinder after the first decompression cycle. For the second decompression cycle, the first cylinder is charged with gas, which comes from the second decompression cycle of the second cylinder and from the first decompression cycle of the third cylinder.

The respective gas can flow out of the second cylinder and the third cylinder via at least one respective outlet duct on the exhaust side of the reciprocating piston internal combustion engine and flow into the first cylinder via the at least one inlet duct of the first cylinder. For this purpose, the three cylinders are fluidly connected to one another via an exhaust manifold, for example, which is arranged on the exhaust side and serves to guide exhaust gas or gas flowing out of the cylinders.

Another embodiment is characterized in that the outlet valve of the first cylinder is kept open after the first opening for at least 210 degrees crank angle after top dead center, in particular after the top ignition dead center of the piston of the first cylinder. The top ignition dead center of the first piston is the top dead center of the piston, in the area of which in the fired operation of the reciprocating piston internal combustion engine the ignition of the fuel-air mixture occurs. This ignition is obviously suppressed in the engine braking mode, wherein the term top ignition dead center only serves to distinguish this top ignition dead center from the top charge change dead center (TDC), which is reached by the first piston upon discharging gas out of the first cylinder.

Due to the fact that the outlet valve of the first cylinder is kept open for at least up to 210 degrees crank angle after the top ignition dead center, the first cylinder can be charged with a particularly large amount of gas, so that a particularly high engine braking performance can be realized.

It has proven to be particularly advantageous if the outlet valves in the engine braking mode perform a shorter stroke than in a normal mode different from the engine braking mode, in particular in traction operation, of the reciprocating piston internal combustion engine. This means that in engine braking mode the discharge valves are not opened at full stroke as in normal operation (fired operation or combustion mode). This full stroke is suppressed during engine braking. Rather, the respective outlet valve is opened with a shorter stroke, both during the first opening and the second opening. It can be provided that the strokes are the same at the first opening and the second opening, or that the outlet valve of the first cylinder is opened with different strokes during first opening and the second opening, in particular with different opening strokes.

The invention also includes a reciprocating piston internal combustion engine for a motor vehicle, which is designed to carry out a method according to the invention. Advantageous embodiments of the method according to the invention are to be regarded as advantageous embodiments of the reciprocating piston internal combustion engine according to the invention and vice versa.

Further advantages, features and details of the invention will become apparent from the following description of a preferred embodiment and from the drawings. The features and feature combinations mentioned above in the description as well as the features and feature combinations mentioned below in the description of the figures and/or which are shown separately in the figures may be used not only in the respectively indicated combination but also in other combinations or individually, without departing from the scope of the invention.

DETAILED DESCRIPTION OF THE DRAWINGS

Figure 1:
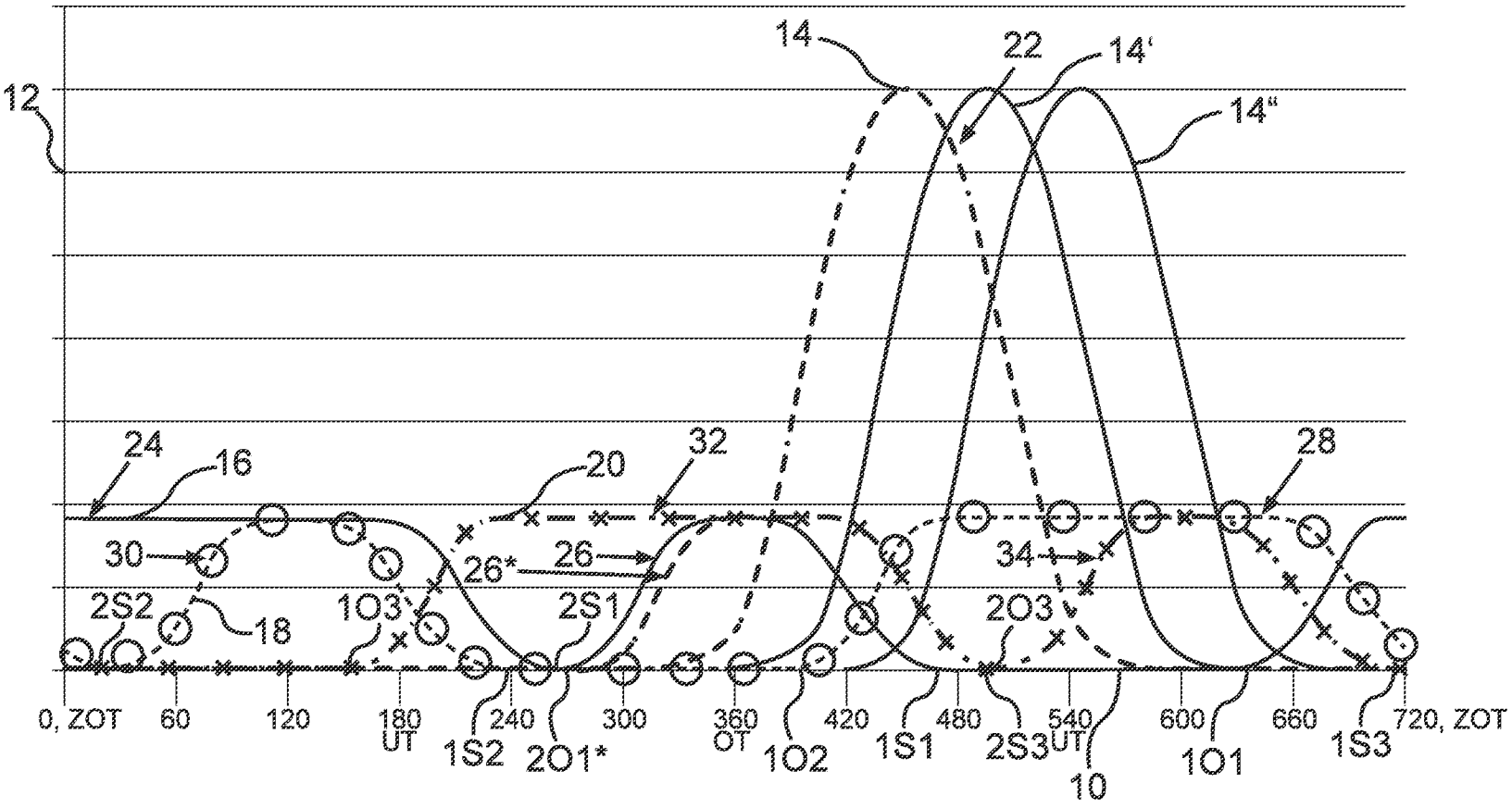
FIG. 1 is a diagram illustrating a method of operating a reciprocating piston internal combustion engine in an engine braking mode, in which three outlet valves of respective cylinders of the reciprocating piston internal combustion engine perform two consecutive decompression strokes within one work cycle, thereby realizing a decompression brake with a particularly high engine braking performance.

In the figures, the same or functionally identical elements are provided with the same reference numerals.

The figures serve to illustrate a method for operating a reciprocating piston internal combustion engine of a motor vehicle. The reciprocating piston internal combustion engine is used to drive the motor vehicle and comprises a total of, for example, six combustion chambers in the form of cylinders. The cylinders are arranged in series, for example. Three first of these cylinders are arranged in a first cylinder bank, wherein three second of these cylinders are arranged in a second cylinder bank. The cylinder banks each have a common exhaust manifold. The method is described with reference to one of the cylinder banks, i.e., with reference to three of the six cylinders, the following embodiments also being readily applicable to the other cylinders and the other cylinder bank.

In a first of the three cylinders, a first piston is arranged, wherein the first piston is translationally movable. In a second of the cylinders, a second piston is arranged, wherein the second piston is translationally movable. In the third cylinder, a third piston is also arranged, which is translationally movable. The three pistons are pivotally coupled via a respective connecting rod to a crankshaft of the reciprocating piston internal combustion engine. The crankshaft is an output shaft and thereby rotatably mounted on a crankcase of the reciprocating piston internal combustion engine about an axis of rotation relative to the crankcase. The articulated coupling of the pistons with the crankshaft converts the translational movements of the pistons into a rotational movement of the crankshaft about its axis of rotation.

In a normal operation of the internal combustion engine, a fired operation of the reciprocating piston internal combustion engine is performed. The fired operation is also referred to as fueled operation. In the context of this fired operation (normal operation), fuel and air are introduced into the respective cylinders. This results in the formation of a fuel-air mixture in the respective cylinder, which is compressed.

The respective cylinder is associated with at least one inlet duct, via which the air can flow into the respective cylinder. The inlet duct of the first cylinder is associated with a first inlet valve, which is movable between at least one closed position fluidly closing the inlet duct of the first cylinder and at least one open position at least partially opening the inlet duct of the first cylinder. Accordingly, the inlet duct of the second cylinder is associated with a second inlet valve which is movable between at least one closed position fluidly closing the inlet duct of the second cylinder and at least one open position at least partially opening the inlet duct of the second cylinder. A third inlet valve is also associated with the inlet duct of the third cylinder, the inlet valve being movable between an open position fluidically closing the inlet duct of the third cylinder and at least one open position at least partially opening the inlet duct of the third cylinder. If the respective inlet valve is in its open position, then the air can flow into the respective cylinder via the respective inlet duct.

An ignition and combustion of the fuel-air mixture generates exhaust gas in the respective cylinder. The cylinders are each associated with at least one outlet duct, via which the exhaust gas can flow out of the respective cylinder. The outlet duct of the first cylinder is associated with a first outlet valve, which is movable between a closed position fluidly closing the outlet duct of the first cylinder and at least one open position fluidly opening, at least partially, the outlet duct of the first cylinder. Consequently, the outlet duct of the second cylinder is associated with a second outlet valve, which is movable between a closed position fluidly closing the outlet duct of the second cylinder and at least one open position fluidly opening, at least partially, the outlet duct of the second cylinder. A third outlet valve is also associated with the outlet duct of the third cylinder, which is movable between an open position fluidically closing the outlet duct of the third cylinder and at least one open position fluidically opening, at least partially, the outlet duct of the third cylinder. If the respective outlet valve is in its open position, then the exhaust gas from the respective cylinder can flow into the respective outlet duct and outwards via the respective outlet duct. In this case, the respective outlet valve and the respective inlet valve are translationally movable. The outlet duct of the first cylinder is also referred to as the first outlet duct. Accordingly, the outlet duct of the second cylinder is referred to as the second outlet duct and the outlet duct of the third cylinder is referred to as the third outlet duct.

The air flows on a so-called inlet side into the respective cylinder. The exhaust gas flows out of the cylinders on a so-called outlet or exhaust side. On the outlet side of the three cylinders of the cylinder bank a common exhaust manifold is arranged, which serves for guiding the outflowing exhaust gas from the cylinders.

The inlet valves and the outlet valves are actuated, for example, by means of an inlet camshaft and an outlet camshaft and are thereby each moved from the respective closed position to the respective open position and optionally held in the open position. This is also called valve control. Through the inlet and outlet camshafts, the inlet valves and the outlet valves are opened at predeterminable times or positions of the crankshaft. Furthermore, in each case, a respective closing of the inlet valves and outlet valves is permitted or effected by the inlet and outlet camshafts at predeterminable times or rotational positions of the crankshaft.

The respective rotational positions of the crankshaft about its axis of rotation are also commonly referred to as the degrees of crank angle [° CA]. The figures now show diagrams on the respective abscissa of which the rotational positions, that is, the degrees of crank angle of the crankshaft are plotted. The reciprocating piston internal combustion engine is designed as a four-stroke engine, wherein a so-called work cycle of the crankshaft comprises exactly two revolutions of the crankshaft. In other words, the work cycle includes a crank angle of exactly 720 degrees. Within such a cycle, that is, within 720 degrees of crank angle, the respective piston moves twice into its respective top dead center (TDC) and twice into its respective bottom dead center (BDC).

The top dead center, in the region of which the compressed fuel-air mixture is ignited in the fired operation of the reciprocating piston internal combustion engine, is also referred to as top ignition dead center (TIDC). The other top dead center of the work cycle is indicated, for example, as the top charge change dead center or charge change TDC (LWTDC). In order to provide a good readability of the diagrams shown in the figures, the top ignition dead center (TIDC) is entered twice, namely once at 720 degrees crank angle and once at 0 degrees crank angle, which is the same rotational position of the crankshaft and the camshaft.

The designations "BDC" for the bottom dead center, "TDC" for the top dead center, and "TIDC" for the top ignition dead center entered into the diagrams shown in the figures refer to the positions of the first piston. The 720 degrees of crank angle shown in the diagrams thus refer to a work cycle of the first cylinder and of the first piston arranged in the first cylinder. With reference to this cycle of the first piston, the second piston and the third piston reach their respective bottom dead center and their respective top dead center or top ignition dead center at different rotational positions of the crankshaft. The following comments to the first outlet valve and the first inlet valve refer to the respective bottom dead center BDC at 180 degrees crank angle and 540 degrees crank angle, the top dead center TDC (top charge cycle dead center) at 360 degrees crank angle and the top ignition dead center TIDC of the first piston at 0 degrees crank angle or 720 degrees crank angle and can easily be transferred to the second outlet valve of the second cylinder, but with respect to the respective bottom dead center, the top dead center and the top ignition dead center of the second piston and to the third outlet valve, but with respect to the respective bottom dead center, the top dead center and the top ignition dead center of the third piston. Based on the respective work cycle of the respective cylinder, the cylinders and thus the outlet valves and the inlet valves are operated in the same way.

The diagrams also each have an ordinate 12, on which a respective stroke of the respective inlet valve and the respective outlet valve is plotted. In or with this stroke, the respective outlet valve or the respective inlet valve is moved, that is, opened and closed. In the diagram shown in FIG. 1, a curve 14 is entered with a dashed line. The curve 14 characterizes the movement, i.e., the opening and closing of the first inlet valve of the first cylinder. For the sake of clarity, only the curve 14 of the first inlet valve of the first cylinder is shown in the diagram. In the diagram, a curve 16 is also plotted with a solid line, which curve characterizes the opening and closing of the first outlet valve of the first cylinder in an engine braking mode of the reciprocating piston internal combustion engine. A curve provided with circles 18 characterizes the opening and closing of the second outlet valve of the second cylinder relative to the cycle of operation of the first cylinder and the first piston. A curve provided with crosses 20 characterizes the opening and closing of the third outlet valve of the third cylinder with respect to the work cycle of the first cylinder. Thus, the curve 18 of the second outlet valve of the second cylinder corresponding to a firing order 1-5-3-6-2-4 of a six-cylinder in-line engine, which is represented retarded by 480 degrees crank angle with respect to the work cycle of the first cylinder and correspondingly the curve 20 of the third outlet valve of the third cylinder is retarded by 240 degrees crank angle. The higher the respective profile 14, 16, 18 and 20, the further the inlet valve or the respective outlet valve is open at an associated rotational position (crank angle) of the crankshaft. If the respective curve 14, 16, 18, 20 is located on the value "0" plotted on the ordinate, i.e., in particular on the abscissa 10, then the inlet valve or outlet valve is closed. In other words, the curves 14, 16, 18 and 20 represent respective valve lift curves of the inlet valve and the outlet valve, wherein the valve lift curve is also referred to as stroke curve.

The method described in the following is performed in an engine braking mode of the reciprocating piston internal combustion engine. From FIG. 1 it can be seen from the curve 14 that the first inlet valve of the first cylinder is opened in the region of the top dead center TDC of the first piston and closed in the region of the bottom dead center BDC of the first piston. Thereby, the first inlet valve performs an inlet stroke 22 so that gas composed of fresh air can flow into the first cylinder via the inlet duct of the first cylinder, and this gas is drawn from the piston moving from the top dead center TDC to the bottom dead center BDC. As can be seen from the curve 16, the first outlet valve is closed twice within a work cycle of the first cylinder or the first piston and is opened twice in the embodiment illustrated in the figures, i.e., it is moved twice in the open position and twice in the closed position.

With reference to the inlet stroke 22 of the first inlet valve, the first outlet valve of the first cylinder is closed for a first time within the work cycle of the first cylinder or the first piston at a rotational position indicated by 1S1, just before 480 degrees crank angle of the crankshaft. The rotational position 1S1 is located in the region of the inlet stroke 22. Within the work cycle of the first cylinder or of the first piston, the first outlet valve is opened for a first time after the first closing at a rotational position designated by 1O1, just before a crank angle of the crankshaft of 660 degrees. Subsequently, the first outlet valve is closed shortly for a second time after 240 degrees of crank angle of the crankshaft at a rotational position designated as 2S1. Subsequently, the first outlet valve is opened for a second time at a rotational position designated as 2O1 at about 270 degrees crank angle of the crankshaft. The first closing (1S1) of the first outlet valve is also referred to as the first movement of the first outlet valve into the closed position of the first outlet valve.

By the first closing (1S1), after the closing of the first inlet valve, the fresh air in the first cylinder is compressed by means of the first piston. By the first opening and the second closing, the first outlet valve performs a decompression stroke 24 within the work cycle of the first cylinder, so that the first cylinder performs a first decompression cycle. The first opening of the first outlet valve is also referred to as the first movement of the first outlet valve into its open position. The second closing of the first outlet valve is also referred to as the second movement of the first outlet valve into its closed position. In this case, by the first opening (at 1O1), the fresh air previously compressed by the first piston or the gas compressed by the first piston is discharged from the first cylinder via the outlet duct of the first cylinder, without being able to use the compression energy stored in the compressed gas, in order to move the first piston from its top dead center to its bottom dead center. Since the reciprocating piston internal combustion engine previously had to apply work to compress the gas, this causes a deceleration of the reciprocating piston internal combustion engine and thus of the motor vehicle. Through the second opening at the rotational position 2O1 and the first closing at the rotational position 1S1, the first outlet valve performs a second decompression stroke 26 within the work cycle of the first cylinder, so that the first cylinder performs a second decompression cycle. The second opening of the first outlet valve is also referred to as the second movement of the first outlet valve into its open position.

As part of the second decompression stroke 26 and the second decompression cycle within the work cycle of the first cylinder or the first piston, the gas compressed by the first piston in the first cylinder is discharged for a second time from the first cylinder via the outlet duct of the first cylinder without using the compression energy stored in this gas to move the piston from top dead center to bottom dead center. As a result, in the engine braking mode, a particularly high braking power, i.e., a particularly high engine braking power, can be realized.

In the engine braking mode, the first outlet valve and the second and third outlet valves perform a substantially lower stroke than in normal operation, that is, in the fired operation of the reciprocating piston internal combustion engine.

It can be seen on the basis of the curve 18 that in the engine braking mode within a work cycle of the second cylinder or the second piston, the second outlet valve of the second cylinder is closed a first time at a rotational position of the crankshaft designated by 1S2. Based on the inlet stroke of the second inlet valve of the second cylinder, which is not shown in the figures, this first closing also takes place in the region of the inlet stroke of the second inlet valve. Within the work cycle of the second cylinder, following the first closing, the second outlet valve of the second cylinder is opened for a first time at a rotational position of the crankshaft designated as 102. Subsequently, within the work cycle of the second cylinder, the second outlet valve is closed for a second time at a rotational position of the crankshaft designated as 2S2 and then opened for a second time at a rotational position of the crankshaft designated as 202. Due to the first opening (at the rotational position 1O2) and the second closing (at the rotational position 2S2) of the second outlet valve, the second outlet valve performs a first decompression stroke 28. Through the second opening and the first closing, the second outlet valve performs, within the work cycle of the second cylinder, a second decompression stroke 30.

Due to the first closing of the second outlet valve, gas in the form of fresh air, which was sucked from the second piston into the second cylinder as a result of the opening of the second inlet valve, is compressed after the closing of the second inlet valve. In the course of the first decompression stroke 28 of the second outlet valve, that is, in the course of a first decompression cycle of the second cylinder, the compressed gas is discharged from the second cylinder via the second outlet duct, so that compression energy stored in the compressed gas cannot be used to move the second piston back from its top dead center to its bottom dead center. This process is repeated in the context of the second decompression stroke 30, so that the second cylinder performs two decompression cycles within the one work cycle of the second cylinder.

The same applies to the third cylinder. In the engine braking mode, as is apparent from the curve 20, within a work cycle of the third cylinder or of the third piston, the third outlet valve is closed for the first time at a rotational position of the crankshaft designated as 1S3. Subsequently, within the operating cycle of the third cylinder, the third outlet valve is opened for a first time at a rotational position of the crankshaft designated as 103. Subsequently, the third outlet valve is closed for a second time at a rotational position of the crankshaft designated as 2S3. Afterwards, the third outlet valve is opened for a second time at a rotational position of the crankshaft designated 203. Due to the first opening (at the rotational position 1O3) and the second closing (at the rotational position 2S3), the third outlet valve performs a first decompression stroke 32 within a work cycle, so that the third cylinder performs a first decompression cycle. As with the first cylinder and second cylinder, the rotational position is 1S3, in which the third outlet valve is closed for the first time within the work cycle of the third cylinder and the third piston, also in the range and preferably in the region of the inlet stroke of the third inlet valve of the third cylinder. As a result of the first closing of the third outlet valve, as in the case of the first cylinder and the second cylinder, gas in the form of fresh air which was sucked by the opening of the third inlet valve into the third cylinder by means of the third piston, is compressed after closing of the third inlet valve by means of the third piston. As a result of the first opening (at the rotational position 1O3) of the third outlet valve, the compressed gas is discharged from the third cylinder, so that compression energy stored in the compressed gas can not be used to move the third piston from its top dead center to its bottom dead center.

As a result of the second opening (at the rotational position 2O3) and the first closing (at the rotational position 1S3) the third outlet valve performs within the cycle of the third cylinder a second decompression stroke 34, wherein in the course of the second decompression stroke 34 of the third outlet valve, the third cylinder performs a second decompression cycle. Also in the second decompression cycle, compressed gas is discharged from the third cylinder via the third outlet duct so that compression energy stored in the compressed gas cannot be used to move the third piston from top dead center to bottom dead center. Like in the case of the first outlet valve within the cycle of the first cylinder and the second outlet valve within the cycle of the second cylinder, the third outlet valve of the third cylinder performs two decompression strokes 32, 34 within the work cycle of the third cylinder, which follow each other within the cycle of the third cylinder. Thus, the three cylinders perform within the respective work cycle each two successive decompression cycles, whereby a particularly high engine braking performance can be realized in the engine braking mode.

The degrees of crank angle at which the second and third outlet valves open and close, respectively, are offset by 480 degrees crank angle and 240 degrees crank angle with respect to the first cylinder, respectively.

In order to realize a particularly high engine braking performance in engine braking mode, it is provided that the first outlet valve of the first cylinder, following the first opening (at the rotational position 1O1) and before the second opening, in particular after the first opening and before the second closing (at the rotational position 2S1), is kept open during the initial decompression, so that the first cylinder is again filled with gas, which flows on the exhaust side via the second outlet duct from the second cylinder, and with gas which flows out on the exhaust side from the third cylinder via the third outlet duct. Based on the curve 16 it can be seen that the first outlet valve is held open until shortly after 240 degrees crank angle after the top ignition dead center TIDC of the first piston or is fully closed only shortly after 240 degrees crank angle after the top ignition dead center. Based on the work cycle of the first cylinder—as can be seen from the figures—the second decompression stroke 30 of the second outlet valve still lies completely within the decompression stroke 24 of the first outlet valve. In addition, the first decompression stroke 32 of the third outlet valve is partially within the first decompression stroke 24, since the third outlet valve—based on the cycle of the first cylinder—is opened already 180 degrees crank angle after the top ignition dead center TIDC of the first piston. This means that during the first decompression of the first outlet valve 24 at least a partial decompression stroke of the second outlet valve (second decompression stroke 30) and a partial decompression stroke of the third outlet valve (first decompression stroke 32) take place. As a result, the first cylinder can be charged with gas from the second cylinder and the third cylinder for the second decompression cycle (decompression stroke 26) following the first decompression cycle (decompression stroke 24), whereby a particularly high engine braking power can be obtained. The first cylinder is filled for its second decompression cycle with gas from the second decompression cycle of the second cylinder and with gas from the first decompression cycle of the third cylinder. In the embodiment of FIG. 1, all three outlet valves are temporarily opened simultaneously by the first opening of the third outlet valve at the rotational position 103, so that the cylinders are fluidly connected to each other via the exhaust manifold.

After the first opening at the rotational position 1O1 and before the second closing at the rotational position 2S1, the first outlet valve should be kept open at least long enough for the first cylinder to be filled with gas, which is exhausted from at least one second cylinder of the reciprocating piston internal combustion engine via at least one outlet duct. This means that the first cylinder should at least be filled with gas from the second or third cylinder.

This principle can also be easily transferred to the second cylinder and the third cylinder. This means that, for example, the second cylinder is filled that is charged with gas from the first cylinder and with gas from the third cylinder, for its second decompression cycle within the work cycle of the second cylinder. The third cylinder is charged within the work cycle of the third cylinder for the second decompression cycle with gas from the first cylinder and with gas from the second cylinder. This is advantageous because—as can be seen for example from the figures with reference to the first cylinder—after the first decompression cycle or after the first decompression stroke before the second decompression cycle or before the second decompression stroke 26 no inlet stroke of the first starting valve is performed anymore. This means that the first cylinder cannot be filled with gas via the inlet duct of the first cylinder after the first decompression cycle and before the second decompression cycle. Therefore, it is intended to fill the first cylinder with gas for its second decompression cycle via the outlet duct of the first cylinder, wherein this gas comes from both the second cylinder and the third cylinder.

Thus, there is an overlap between the second closing of the first outlet valve and the first opening of the third outlet valve—based on the cycle of the third cylinder. Advantageously, as a result of the overlapping of the respective opening of a first outlet valve and the closing of a third outlet valve and/or the closing of a second outlet valve, pressure peaks in the exhaust manifold may be reduced by discharging the gas from the first cylinder and flowing into the second cylinder or third cylinder.

Figure 2:
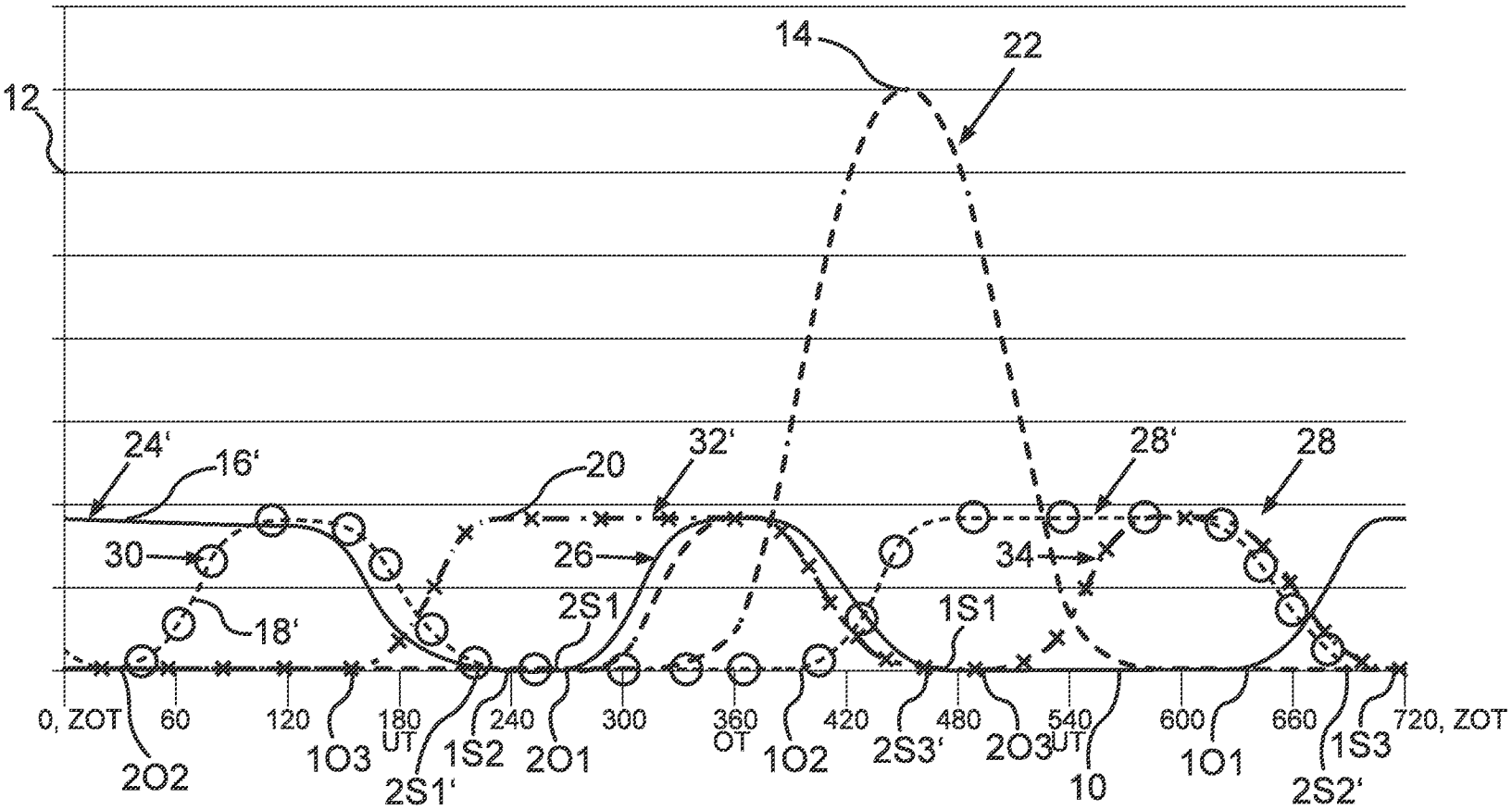
FIG. 2 is an alternative embodiment to FIG. 1.

FIG. 2 shows an alternative embodiment to FIG. 1. The same lines and the same points as in FIG. 1 are given the same reference numerals in FIG. 2. In the diagram of FIG. 2 the curve 14 of FIG. 1 is plotted unchanged. Curves 16', 18' and 20' have, in contrast to FIG. 1 decompression strokes 24', 28' and 32' which close earlier. The second closing at the respective rotational position 2S1', 2S2' and 2S3' of the first decompression strokes 24', 28' and 32' takes place in each case approximately 30 degrees crank angle earlier. Thus, for example, the first outlet valve closes at about 210 degrees crank angle and the first closing times at the rotational positions 1S 1, 1S2 and 1S3 of the second unchanged decompression strokes 26, 30 and 34 lie temporally after the second closing at the rotational positions 2S1', 2S2' and 2S3' of the first decompression strokes 24', 28' and 32'.

Figure 3:
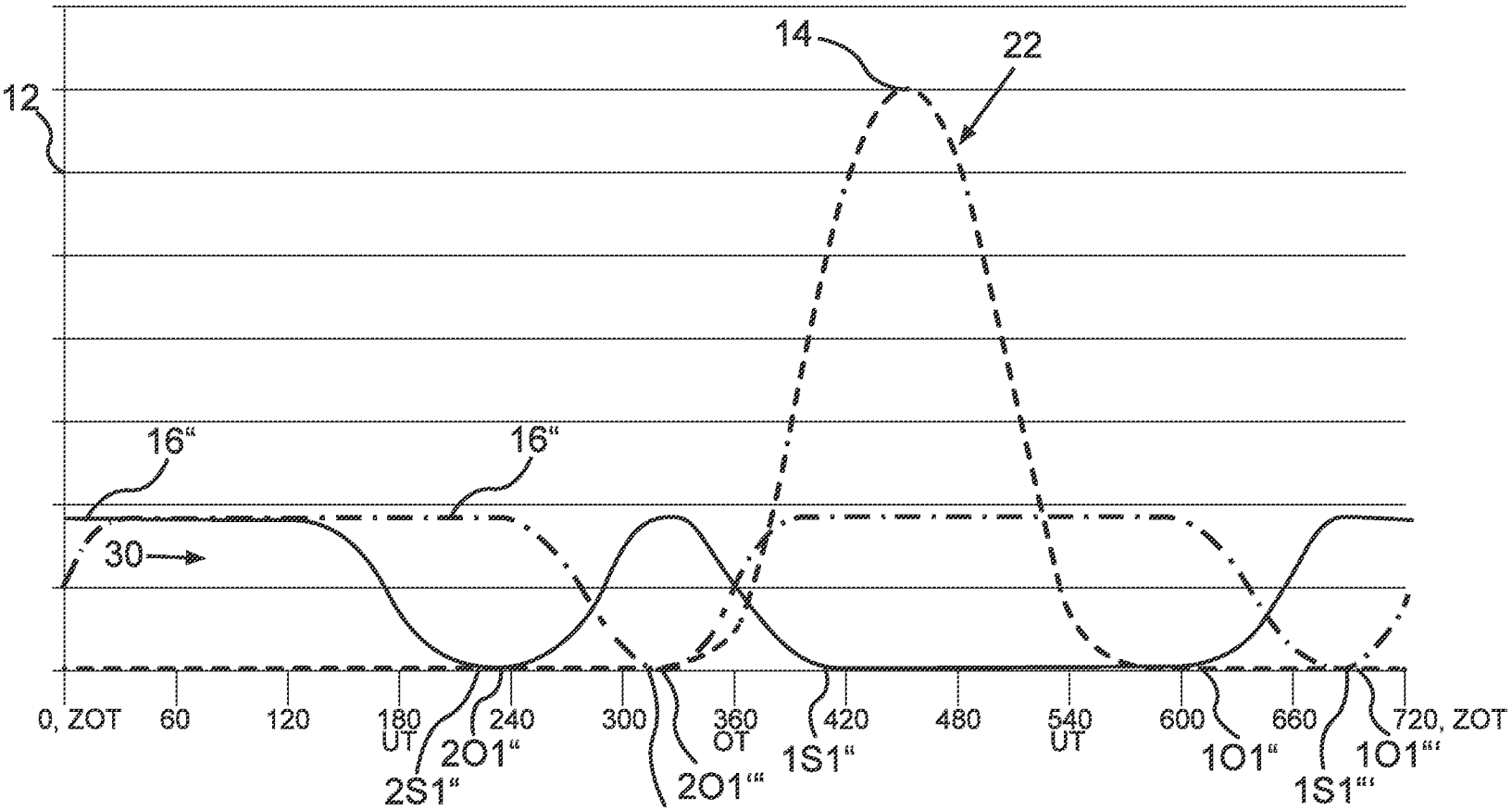
FIG. 3 is a diagram for illustrating preferred ranges of the respective opening and closing times of the two consecutive decompression strokes using a first outlet valve.

FIG. 3 shows a diagram illustrating preferred ranges of the respective opening and closing times of two successive decompression strokes with reference to the first outlet valve. The following descriptions are readily transferable to the other cylinders and the other cylinder bank. Equal lines and points in FIG. 3 are provided with the same reference numerals as in FIGS. 1 and 2. In the diagram of FIG. 2 the unchanged curve 14 of FIG. 1 is entered. Furthermore, in FIG. 3, two curves 16" (solid line) and 16'" (dashed line) of the first outlet valve are plotted, wherein the curve 16" indicates the earliest possible opening times at the rotational position 1O1" at about 610 degrees crank angle and 2O1 "at about 230 degrees crank angle and closing times at the rotational positions 1S1" at about 400 degrees crank angle and 2S1" at about 210 degrees crank angle, respectively. Accordingly, the curve 16'" indicates the latest possible opening times at the rotational positions 1O1'" at about 680 degrees crank angle and 2O1" at about 320 degrees crank angle and closing times at the rotational positions 1S 1" at about 680 degrees crank angle and 2S1'" at about 320 degrees crank angle. The resulting ranges of possible first and second opening times and first and second closing times can be combined as desired.

In order to realize a particularly high braking power, i.e., a particularly high engine braking power, it is further contemplated that upon activating the engine braking mode, the camshaft is adjusted by means of a camshaft adjuster for actuating the inlet valves and thereby it is retarded relative to the crankshaft. The camshaft for actuating the inlet valves is also referred to as inlet camshaft. The function and effect of the adjustment of the inlet camshaft will be described below using the example of the first cylinder. At least one inlet valve and at least one inlet duct are associated with the first cylinder, wherein the inlet valve is associated with the inlet duct. The inlet valve is adjustable between a closed position and at least one open position, wherein the inlet duct of the first cylinder is completely closed by the inlet valve in its closed position. In the open position, the inlet valve opens the inlet duct at least partially. In this case, the inlet valve is movable by means of the camshaft from its closed position to its open position. In the diagram in FIG. 1, the curve 14 of the opening and closing of the inlet valve of the first cylinder is indicated by a dashed line.

The camshaft adjuster now allows a shifting of the crank angle range in which the inlet valve is opened, toward later crank angles. In the diagram in FIG. 1, a solid line shows the curve 14' of the opening and closing of the inlet valve of the first cylinder at later crank angles. In the embodiment shown in FIG. 1, the curve 14' of the opening and closing of the inlet valve is retarded by approximately 45 degrees crank angle relative to the curve 14. Thus, the inlet valve does not open before the top dead center (TDC), but after top dead center (TDC). The closing of the inlet valve shifts accordingly. Thus, the opening timing at which the inlet valve is opened can be advanced so far that a pressure in the first cylinder, which is also called cylinder pressure, due to the open outlet valve and the downward movement of the piston after top dead center (TDC) has dropped so much, that a limit value for a maximum cylinder pressure with open inlet valve is maintained even if the maximum cylinder pressure during compression is 60 bar or more, that is particularly high. In other words, it is thus possible to be able to realize particularly high pressures in the first cylinder during the second decompression or during the second decompression stroke. Due to the adjustment of the inlet camshaft, it is possible, despite these high cylinder pressures, to open the inlet valve, which must be opened against the pressure in the first cylinder, and thus to allow the filling of the first cylinder with the gas, since the pressure in the first cylinder when opening the inlet valve is less than the maximum allowable cylinder pressure. As a result, a particularly high braking performance can be realized.

The braking power can be further increased by the respective second opening of the respective outlet valve for the second decompression stroke taking place later together with the above-mentioned retardation of the inlet valve. In FIG. 1, this is shown by way of example with reference to a dotted curve 26* for the second decompression stroke of the first outlet valve. The rotational position 2O1 of the second opening of the first outlet valve is then retarded in the direction of the rotational position 2O1*, whereby the respective rotational position is also referred to as a time or a point in time. In contrast, the rotational position (time) 1S1 of the first closing of the first outlet valve remains unchanged. This can be represented by a corresponding change in the exhaust cam contour. The late opening of the outlet valve can increase the compression of the gas in the cylinder, resulting in a higher braking performance.

It is also conceivable, analogously to the adjustment of the inlet camshaft by means of a camshaft adjuster, to provide a corresponding camshaft adjuster for the outlet camshaft. This can variably select a time of opening of the outlet valve, in particular in a retarding direction. The timing of closing of the outlet valve shifts accordingly.

Furthermore, it may be advantageous to set low or very low braking performances. For this purpose, the opening and closing of the inlet valve can be further adjusted in the retarding direction. As a result, the gas in the cylinder is pushed out of the open inlet duct by the upward movement of the piston, so that less gas is available for compression of the cylinder after closing the inlet valve, thereby venting less gas in the first decompression. In the diagram in FIG. 1, the curve 14" of the opening and closing of the inlet valve of the first cylinder is retarded by about 120 degrees crank angle with respect to the curve 14. Thus, the inlet valve opens significantly after top dead center (TDC). The closing of the inlet valve shifts accordingly. The upward movement of the piston toward its top dead center (TIDC) limits this retardation to reduce braking power. In order to prevent a collision of the inlet valve with the piston, the inlet valve must be closed in time. Through the use of the camshaft adjuster, which is also referred to as a phase adjuster, and the thus caused adjusting of the camshaft, in particular of the inlet camshaft, it is possible to realize an engine brake and thus an engine brake system having a variable inlet valve lift curve, since by adjusting the inlet camshaft, the lifting curve of the inlet valve can be varied. By operating the gas exchange valves described above, it is also possible to realize the engine braking system as a three-stroke engine braking system, so that a particularly high braking performance and also very low braking performances can be achieved.

Usually, the engine braking mode is followed by a starting of the reciprocating piston internal combustion engine. The starting of the reciprocating piston internal combustion engine means that the reciprocating piston internal combustion engine is transferred from its unfired operation to its fired operation, so that, for example, the reciprocating piston internal combustion engine is transferred from the engine braking mode to normal operation. Starting the reciprocating piston internal combustion engine is also referred to as activation.

In order to keep the thermodynamic losses resulting from the starting of the reciprocating piston internal combustion engine at a particularly low level and thus to realize a particularly efficient operation of the reciprocating piston internal combustion engine,—in particular in contrast to the previous embodiments and in contrast to the functions and movements of the respective outlet valves described with reference to the figures—, it is provided that instead of the second closing of the first outlet valve, that is, instead of the second movement of the first outlet valve into the closed position, a movement or actuation of the first outlet valve occurs, such that the first outlet valve is moved, after the first opening (at the rotational position 1O1), that is, after the first movement into the open position, and before the second opening (at the rotational position 2O1), that is, before the second movement into the open position, in the direction of the closed position but not into the closed position, but in an intermediate position of the first outlet valve which differs from the closed position and from the open position of the first outlet valve, wherein the first outlet valve closes the associated outlet duct in the intermediate position more than in the open position and opens it more than in the closed position.

In other words, it is provided that the first outlet valve is kept open during the movement in the direction of the closed position, which follows the first movement into the open position (at the rotational position 1O1) and precedes the second movement into the open position (at the rotational position 2O1) for such a long period of time, that the first cylinder is filled with gas, which flows via the second outlet duct from the second cylinder of the reciprocating piston internal combustion engine and which optionally flows via the third outlet duct from the third cylinder, wherein upon activation of the engine braking mode, the camshaft is adjusted for actuating the gas exchange valve, in particular the inlet valve, and wherein during the movement in the direction of the closed position, which follows the first movement in the open position (at the rotational position 1O1) and precedes the second movement in the open position (at the rotational position 2O1), a movement of the first outlet valve into the closed position is suppressed.

For example, with reference to the figures and relative to the first cylinder, this means that between the rotational positions 1O1 and 2O1, in particular between the rotational positions 2S1 and 2O1, the first outlet valve is no longer completely closed, but only partially closed, so that the first outlet valve is moved, for example, upon the first opening from the closed position to the open position, and then from the open position to the intermediate position and then upon the second opening from the intermediate position to the open position. As previously stated, this actuation or movement of the first outlet valve is readily transferable to the outlet valves of the second cylinder and the third cylinder.

As a result of this actuation of the first outlet valve, the gas can escape from the first cylinder before the charge-exchange TDC, so that no appreciable compression occurs in the first cylinder, especially at low rotational speeds. As a result, for example, when starting the reciprocating piston internal combustion engine, it is not necessary to work against an excessive compression of the gas taking place in the first cylinder or only against a particularly slight compression of the gas in the first cylinder, so that thermodynamic losses can be kept particularly low. As a result, excessive excitations and thus excessive vibrations of the reciprocating piston internal combustion engine can be avoided, so that the reciprocating piston internal combustion engine can be started in a particularly comfortable manner.

It has been found to be particularly advantageous if the inlet camshaft is set to a late position, for example, at 120 degrees of crank angle, so that even at the top ignition dead center no compression occurs since either the inlet valve or the outlet valve of the first cylinder is always open.

The invention claimed is:

1. A method for operating a reciprocating piston internal combustion engine in an engine braking mode, comprising the steps of:

moving an outlet valve of a first cylinder, within a work cycle, for a first time into a closed position, subsequently from the closed position for a first time into an open position, subsequently from the open position in a direction of the closed position, and subsequently for a second time into the open position in order as a result to discharge gas which has been compressed in the first cylinder by a piston of the first cylinder out of the first cylinder;

wherein the outlet valve is held open during the moving in the direction of the closed position for such a long time that the first cylinder is filled with gas which flows via an outlet duct out of a second cylinder of the reciprocating piston internal combustion engine;

wherein, during activation of the engine braking mode, a camshaft of the reciprocating piston internal combustion engine is adjusted;

wherein the outlet valve is moved, during the moving in the direction of the closed position, into an intermediate position which is different from the open position and the closed position and which lies between the open position and the closed position, wherein from the intermediate position the outlet valve is moved for the second time into the open position;

wherein the outlet valve in the intermediate position closes the outlet duct more than in the open position and opens it more than in the closed position.

2. The method according to claim 1, wherein the camshaft is an inlet camshaft via which an inlet valve associated with an inlet duct of the first cylinder is actuatable.

3. The method according to claim 1, wherein the camshaft is retarded.

4. The method according to claim 2, wherein the inlet camshaft is retarded such that the inlet valve is open during a top ignition dead center of the work cycle.

5. A reciprocating piston internal combustion engine for a motor vehicle which is configured to perform the method according to claim 1.

* * * * *